United States Patent [19]

Phillippi et al.

[11] Patent Number: 4,534,383

[45] Date of Patent: Aug. 13, 1985

[54] FLUIDIC SET POINT PRESSURE SENSOR

[75] Inventors: R. Michael Phillippi, Highland; Thadeusz M. Drzewiecki, Silver Spring, both of Md.

[73] Assignee: The United States of America as represented by the Secretary of the Army, Washington, D.C.

[21] Appl. No.: 547,166

[22] Filed: Oct. 31, 1983

[51] Int. Cl.[3] ..... F15C 1/08

[52] U.S. Cl. ..... 137/840; 137/829; 137/833

[58] Field of Search ..... 137/833, 839, 840, 829

[56] References Cited

U.S. PATENT DOCUMENTS

| | | | |
|---|---|---|---|
| 3,420,255 | 1/1969 | Wilkerson | 137/840 |
| 3,529,612 | 9/1970 | Rausch | 137/835 |
| 4,369,811 | 1/1983 | Monion et al. | 137/819 |

*Primary Examiner*—A. Michael Chambers

*Attorney, Agent, or Firm*—Anthony T. Lane; Robert P. Gibson; Saul Elbaum

[57] ABSTRACT

A mechanically offset fluid amplifier for converting the absolute pressure of a pressurized fluid to a differential pressure indicating the pressure of the pressurized fluid relative to a predetermined set point pressure. The device includes two outlets separated by a splitter, a supply nozzle for directing a jet of the pressurized fluid toward a first of the two outlets at a velocity determined by the absolute pressure, and control elements for deflecting the jet toward the second outlet such that as the jet velocity increases from zero, the deflection of the jet increases to a maximum value and then decreases until the differential pressure between the two outlets is equal to zero when the absolute pressure of the pressurized fluid is equal to the predetermined set point pressure. The control elements includes two control inlets disposed on opposite sides of the jet and connected to a common source of control fluid through respective fluidic resistances, the second control inlet being disposed on the same side of the jet at the second outlet. The first and second control inlets include respective first and second forward control edges which are asymmetrically disposed on opposite sides of the jet so that the second control edge is disposed closer to the supply nozzle centerline than the first control edge.

10 Claims, 2 Drawing Figures

FLUIDIC SET POINT PRESSURE SENSOR

RIGHTS OF THE GOVERNMENT

The invention described herein may be manufactured, used and licensed by or for the U.S. Government for governmental purposes without payment to me of any royalties thereon.

BACKGROUND OF THE INVENTION

U.S. patent application Ser. No. 492,120, filed May 1983 Tadeusz Drzewiecki, describes a fluidic apparatus for converting the absolute pressure of a pressurized fluid to a differential pressure indicating the fluid pressure relative to a reference pressure. The pressurized fluid is directed asymmetrically into a laminar proportional amplifier (LPA) along a centerline towards a first of two outlets at a velocity determined by the fluid pressure. The LPA includes first and second control inlets disposed on opposite sides of the directed fluid jet and connected to a common source of control fluid, the first control inlet being disposed on the same side as the first outlet and the second control inlet being disposed on the same side as the second outlet. The first and second control inlets include respective first and second downstream control edges which are asymmetrically disposed on opposite sides of the jet, with the second control edge being disposed closer than the first control edge to the centerline. Consequently, the jet is deflected towards the second outlet in accordance with the jet velocities such that the differential pressure generated by the jet between the first and second outlets is zero when the fluid pressure is equal to the reference pressure. The first and second control inlets may include variable fluidic resistors which can be varied to adjust the reference pressure.

SUMMARY OF THE INVENTION

The invention described hereinafter is similar to the pressure converter described in the above-referenced U.S. patent application Ser. No. 492,120. However, the elements of the invention described herein are dimensioned and disposed such that, as the pressure of the pressurized fluid supplied to the LPA is increased from zero, the differential pressure generated by the jet of pressurized fluid between the first and second outlets of the LPA is zero at two different supply pressures, the lower of these two pressures corresponding to the predetermined reference pressure in the pressure converter described in the above-referenced U.S. patent application No. 492,120.

In the present invention, the predetermined reference pressure is determined by the higher of these two pressures at which the differential pressure generated by the jet between the first and second outlets is zero. By so dimensioning and spacing the elements of this mechanically offset LPA so that the differential pressure generated by the jet between the first and second outlets is zero at two different predetermined pressures of the jet, and by utilizing the higher of these two predetermined pressures as the reference pressure for the system, not only can much higher reference pressures be easily obtained, but also much higher gains can be obtained, even to the point that the invention can be utilized as a flip-flop device.

BRIEF DESCRIPTION OF THE DRAWINGS

The invention will be better understood and further objects, features and advantages thereof will become more apparent from the following description of preferred embodiments, taken in conjunction with the accompanying drawings in which.

DESCRIPTION OF PREFERRED EMBODIMENTS

Figure 1:
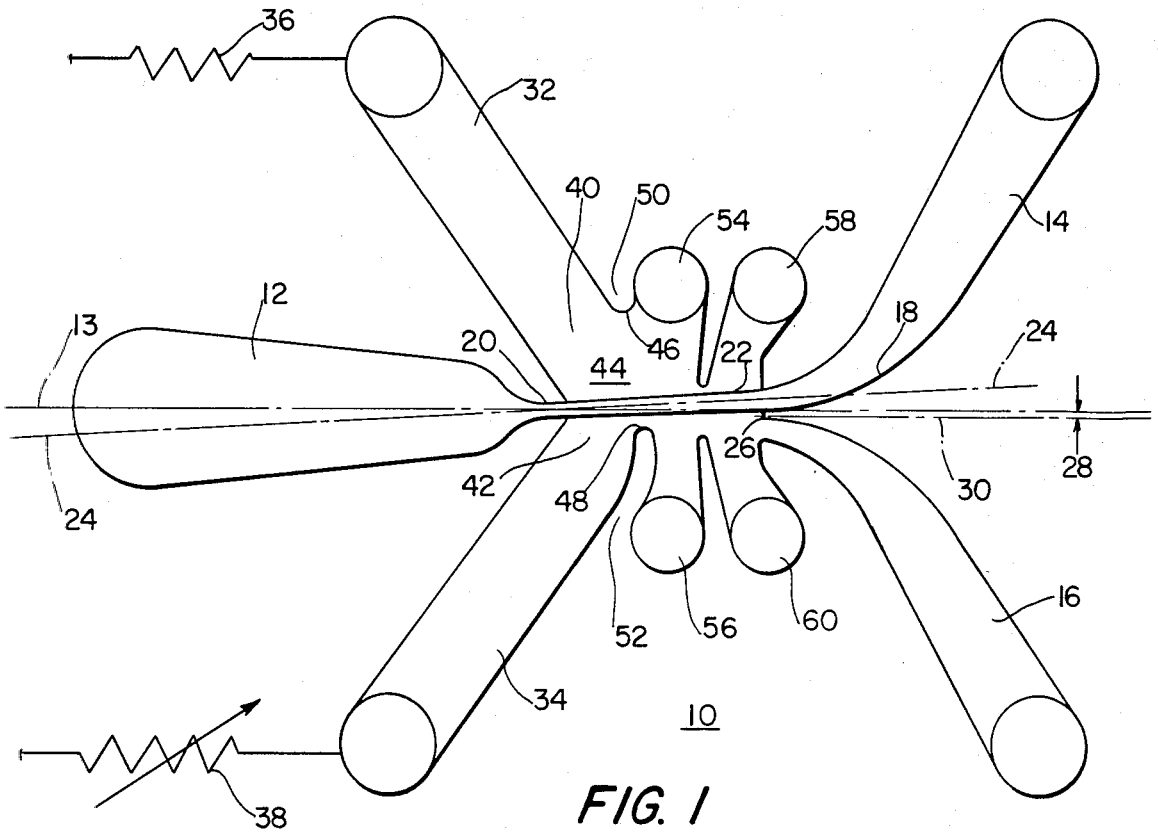
FIG. 1 is a plan view of a first embodiment of the invention.

The set point pressure sensor 10 shown in FIG. 1 includes a supply input 12 which is disposed at one end of the sensor 10 and is connected to receive a fluid whose absolute pressure is to be converted to a differential pressure indicating the pressure of the fluid relative to a desired set point pressure. Two fluid outlets 14, 16, separated by a splitter 18, are disposed at an opposite end of the sensor 10. A supply nozzle 20 is connected in fluid communication with the supply input 12 to direct a fluid supply stream 22 from the supply input 12 into the sensor 10 along a centerline 24 of the supply nozzle 20. The supply nozzle centerline 24 is offset in a lateral direction from the upstream end 26 of the splitter 18 such that most of the supply stream 22 is directed by the supply nozzle 20 towards the output 14. This offset can be achieved by either or both of two methods, both of which are utilized in the embodiment of FIG. 1 herein. When the two outputs 14, 16, are disposed symmetrically on opposite sides of an axis 30 of the splitter 18, the splitter axis 30 can be disposed parallel to, and spaced from the supply input axis 13, by distance 28 as shown in FIG. 1. Also, the supply nozzle axis 24 can be disposed to intersect the supply input axis 13 upstream of the splitter 18, as also shown in FIG. 1, to achieve the desired lateral offset of the supply nozzle centerline 24 at the splitter end 26.

Two control ports 32, 34 are connected to an available control fluid source through respective fluid resistors 36, 38, which may be either linear or nonlinear, fixed or adjustable resistors. For example, when the supply stream is formed of pressurized air, the ambient air surrounding sensor 10 can be used as a control fluid source for the control ports 32 and 34. When the fluid used to form supply stream 22 is a liquid, the control fluid source for the control ports 32, 34 can be a low pressure return line of the fluid system.

The control ports 32 and 34 include respective control nozzles 40, 42, which are disposed on opposite sides of the supply stream 22 to establish fluid communication between the control ports 32, 34 and an interaction zone 44 which extends between the control nozzle 20 and the edges 46, 48 of two control nozzle vanes 50, 52, respectively. The two control nozzle vanes 50, 52 are disposed asymmetrically relative to the supply nozzle axis 24, wherein the vane edge 48 is disposed closer than the vane edge 46 to the axis 24. Since these vane edges 46, 48 determine not only the length but also the lateral extent of the interaction zone 44, this interaction zone 44 is also asymmetrically offset from the supply nozzle centerline 24.

The sensor 10 also includes two sets of vents 54 and 56, 58 and 60, which are disposed on opposite sides of the supply stream path intermediate the interaction zone 44 and the outlets 14, 16, and which are open to ambient pressure to provide dumping points for fluid inside the sensor 10.

OPERATION

When the fluid stream 22 is flowing through the sensor 10, fluid from the available control fluid source will be drawn through the two flow resistors 36, 38, the two control ports 32, 34, and the two control nozzles 40, 42, respectively, to become entrained with the supply stream 22. In the preferred embodiment of the invention shown in FIG. 1, the edge 46 of the control nozzle vein 50 is disposed at such a distance from the supply stream 22 that there is free interchange between the control port 32 and the vent 54, so that the pressure in the interaction zone 44 on the same side of the supply stream 22 as the control port 32 and vent 54 is essentially maintained at ambient pressure. However, the pressure in the interaction zone 44 on the same side as supply stream 22 as the control port 34 will be a negative pressure which is less than the ambient pressure at the control fluid source by the pressure drop caused by the flow of control fluid from the control fluid source through the fluid resistor 38, the control port 34, and the control nozzle 42 to the supply stream 22. Thus, during operation of the converter 10, the pressure at the control nozzle 40 is not affected substantially by the value of the flow resistor 36, but the negative pressure at the control nozzle 42 will vary directly as the value of the flow resistor 38. For this reason, in the preferred embodiment of the invention, the fluid resistor 36 is a fixed resistor which may consist merely of the inherent resistance of the passage connecting the control fluid source and the control port 32, and the fluid resistor 38 is a variable resistor for controlling the negative pressure at the control nozzle 42.

At very low supply pressures, the difference between the ambient pressure at the nozzle 40 on one side of the fluid stream 22 and the negative pressure at the nozzle 42 on the other side of the fluid stream 22 is so small in magnitude that it has no effect on the fluid stream 22, and most of this fluid stream is received in the fluid output 14. As the supply pressure is increased, the pressure at the control nozzle 42 becomes more negative and eventually pulls the fluid stream 22 towards the fluid outlet 16. With still larger increases in supply pressure, the pressure at the control nozzle 42 will eventually become essentially constant. When the momentum of the fluid stream becomes large enough, the difference between the negative pressure at the control nozzle 42 and the ambient pressure at the control nozzle 44 will not be strong enough to maintain deflection of the fluid stream 22 into the outlet 16, and the fluid stream 22 will swing back towards the output 14. Thus, as the fluid supply pressure increases from zero, the differential pressure between the two outputs 14, 16 first reverses its sign at a relatively low supply pressure and again reverses its direction or sign at a higher supply pressure corresponding to a desired set point pressure. Both this set point pressure at which the differential pressure between the two outputs 14 and 16 become zero for the second time and the rate of change of this differential pressure with a change in the supply pressure is directly proportional to the resistance value of the fluid resistor 38.

Figure 2:
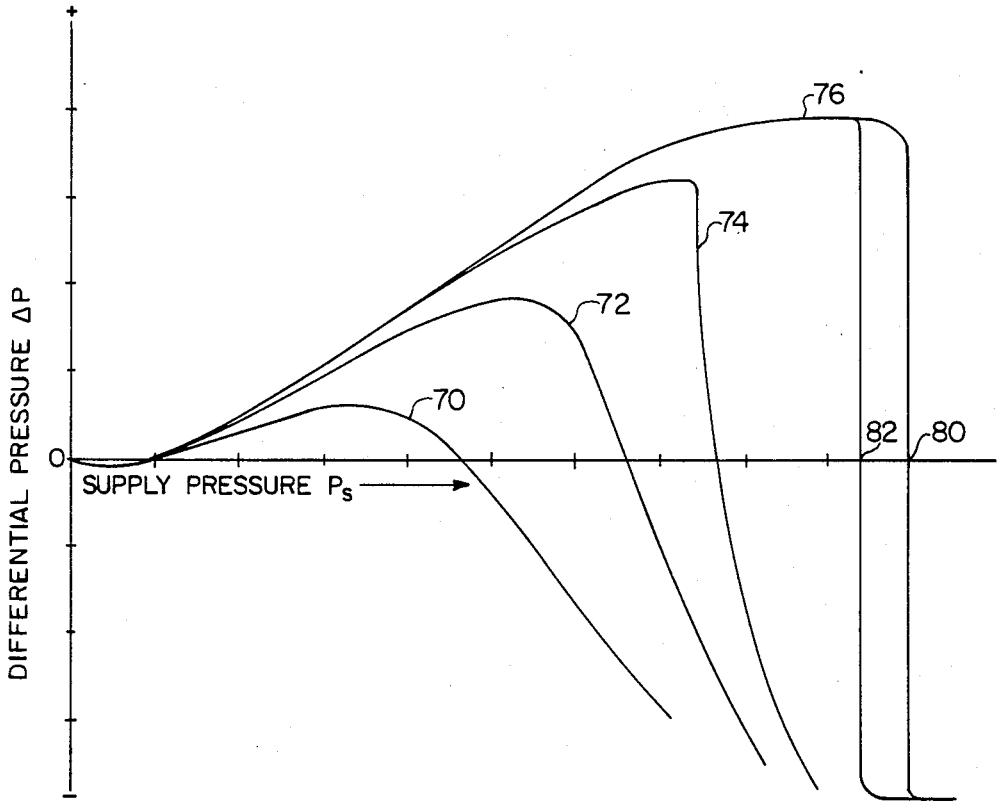
FIG. 2 is a family of curves of LPA input versus output pressure signals for respective LPA control resistances.

FIG. 2 shows typical curves 70, 72, 74, 76 of the supply pressure $P_s$ at the sensor supply input 12 versus the differential pressure $\Delta$ P produced between the two outputs 14 and 16 for various resistance values of the fluid resistor 38, curve 70 corresponding to the lowest resistance value and curve 76 corresponding to the highest resistance value of the fluid resistor 38. In order to indicate whether the pressure at one output 14 is greater or less than the pressure at the other output 16, the differential pressure $\Delta$ P has been arbitrarily designated as a positive value when the pressure at the output 16 is greater than the pressure at the output 14, and as a negative value whenever the pressure at the output 16 is less than the pressure at the output 14.

As the supply pressure $P_s$ is increased from zero, the differential pressure $\Delta$ P is initially negative, indicating most of the supply stream 22 is directed towards the fluid output 14. As the supply pressure is further increased, the differential pressure $\Delta$ P between the two outlets decreases to zero, then increases in a positive direction, indicating that most of the supply stream 22 is now directed towards the fluid outlet 16, rather than the outlet 14. This is true regardless of the resistance value of the fluid resistor 38, i.e. for all of the curves 70–76.

As the supply pressure continues to increase, the differential pressure $\Delta$ P between the two outlets will reverse, decreasing to zero and then increasing in the negative direction. As can be seen from FIG. 2, the supply pressure at which the value of $\Delta$ P decreases to zero varies directly with the resistance value of the fluid resistor 38. Thus, this zero crossover value of the supply $P_s$ is lowest for curve 70, and highest for curve 76. Also, as shown in FIG. 2, the slope of the curve at the zero point increases with increasing values of the fluid resistor 38, until finally, as shown in curve 76, the slope of this line becomes vertical and the curve 76 includes a hysteresis loop, wherein the supply pressure 80, at which the differential $\Delta$ P switches from a positive value to a negative value as the supply pressure $P_s$ increases, is greater than the supply pressure 82, at which the differential pressure $\Delta$ P switches from a negative value to a positive value as the supply pressure $P_s$ decreases.

An example of a fluidic set point pressure sensor 10, such as shown in FIG. 1, is seen below. In this example, the pressurized fluid is pressurized air and the control fluid is air at atmospheric pressure. The nozzle 20 is 0.012 inches wide by 0.01 inches deep. The fluid outputs 14 and 16 are 0.02 inches wide by 0.01 inches deep. The flow splitter 18 has a rounded upstream end 26 of approximately 0.004 inch diameter which is spaced from the supply nozzle 20 by a distance of approximately 0.173 inch. The central line 30 of the splitter 18 is offset 0.004 inch from the supply nozzle centerline 24 in one lateral direction, and the interaction zone 44 is offset from the supply nozzle centerline 24 in an opposite lateral direction, as shown in FIG. 1. The edge 46 of the control nozzle vane 50 is spaced approximately 0.0865 inch from the supply nozzle centerline 24, and the edge 48 of the control nozzle vane 52 is spaced approximately 0.0143 inch from the centerline 24. The control nozzle vane 52 is disposed downstream from supply nozzle 20 by a distance of approximately 0.077 inch along the centerline 24. The nozzle axis 24 is tilted at an angle of approximately 2.8° relative to the supply input axis 13 so that the nozzle axis 24 extends toward the fluid outlet 14.

The jet edge clearance between the vane edge 48 and the jet 22 is a critical dimension for any design of the set point pressure sensor described herein. If this clearance is too small, i.e., the vane 48 is too long, the converter will be inoperative since the vane 52 will partially block flow of the jet 22 into the outlet 16, and the pressure at the outlet 16 will never become greater than the pressure at the outlet 14. Similarly, if this clearance is too large, i.e., the vane 52 is too short, the negative pressure generated at the control nozzle 42 will be insufficient to divert most of the jet 22 into the outlet 16, because of the increased communication between the control nozzle 42 and the vent 56, which is at ambient pressure.

The pressure sensor 10 described herein can be utilized in the same apparatus and for the same purposes as the pressure converter 10 described in the above-referenced U.S. patent application Ser. No. 492,120.

Since various modifications variations and additions to the invention are possible in the spirit of the invention in addition to the specific embodiment described herein, it is intended that the scope of the invention be limited only by the appended claims.

What is claimed and desired to be secured by letter of this patent of the United States:

1. A fluidic set point pressure sensor for converting the absolute pressure of a pressurized fluid to a differential pressure indicating the pressure of the pressurized fluid relative to a predetermined set point pressure, comprising:

input means, connected to receive said pressurized fluid, for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet; and control means for deflecting said jet towards said second outlet in accordance with said jet velocity such that as the jet velocity increases from zero, the deflection of the jet increases to a maximum value, then decreases, so that the differential pressure generated by the jet between the first and second outlets increases to a maximum positive value at which the pressure at the second outlet is greater than the pressure at the first outlet, then decreases to a negative value at which the pressure at the first outlet is greater than the pressure at the second outlet, the differential pressure being equal to zero when said absolute pressure is equal to said predetermined set point pressure, the differential pressure becoming positive whenever said absolute pressure falls below said set point pressure and becoming negative whenever said absolute pressure rises above said set point pressure.

2. A sensor, as described in claim 1, wherein said control means comprises:

a first vane which is disposed downstream from the input means on a first side of the jet adjacent the first outlet and which extends radially inward toward the first centerline to a first vane edge;

a second vane which is disposed opposite the first vane on a second side of the jet adjacent the second outlet and which extends radially inward toward the first centerline to a second vane edge which is disposed closer to the first centerline than the first vane edge;

an interaction zone which is defined by and extends between the input means and the first and second vanes;

a source of control fluid of low pressure which is constant relative to the predetermined set point pressure;

a first resistive fluid communication means for connecting the control fluid source in fluid communication with the first side of the jet in the interaction zone; and a second resistive fluid communication means for connecting the control fluid source in fluid communication with the second side of the jet in the interaction zone.

3. A sensor, as described in claim 2, wherein the second resistive fluid communication means comprises a variable fluidic resistor.

4. A sensor, as described in claim 3, which further comprises means for venting fluid interposed between the first and second vanes and the output means.

5. A sensor, as described in claim 4, wherein the pressurized fluid is pressurized air and the control fluid source is ambient air at atmospheric pressure.

6. A sensor, as described in claim 5, wherein the fluid venting means includes at least one pair of vents disposed respectively on opposite sides of the jet between the first and second vanes and the output means, for establishing fluid communication between the ambient air and the opposite sides of the jet.

7. A sensor, as described in claim 5, wherein the flow resistance of the first resistive fluid communication means is very small relative to the flow resistance of the second resistive fluid communication means.

8. A fluidic set point pressure sensor for converting the absolute pressure of a pressurized fluid to a differential pressure indicating the pressure of the pressurized fluid relative to a predetermined set point pressure, comprising:

input means, connected to receive said pressurized fluid, for directing a jet of fluid along a first centerline at a velocity determined by said absolute pressure;

output means, disposed downstream from said input means, including first and second outlets separated by a splitter which is disposed asymmetrical to said first centerline such that at least a greater portion of said jet directed along said first centerline is received at the first outlet; and control means for deflecting the jet towards the second outlet in accordance with the jet velocity such that as the jet velocity increases from zero, the deflection of the jet increases to a maximum value and then decreases, so that the differential pressure generated by the jet between the first and second outlets increases to a maximum positive value and then decreases to a negative value, the differential pressure being equal to zero when the absolute pressure of the pressurized fluid is equal to the predetermined set point pressure, the differential pressure becoming positive whenever said absolute pressure falls below said set point pressure and becoming negative whenever said absolute pressure rises above said set point pressure, said control means including first and second control fluid inlets respectively disposed on opposite sides of the jet and connected to a common source of control fluid through respective first and second fluidic resistive means, the second control inlet being disposed on the same side of the first centerline as the second outlet, the first and second control fluid inlets including respective first and second forward control edges which are asymmetrically disposed on opposite sides of the jet so that the second control edge is disposed closer that the first control edge to the first centerline.

9. A sensor, as described in claim 8, wherein the fluidic resistance of the first fluidic resistive means is less that the fluidic resistance of the second fluidic resistive means.

10. A sensor, as described in claim 9, wherein the second fluidic resistive means comprises an adjustable fluidic resistor.

* * * * *